US008859919B2

(12) United States Patent
Chen

(10) Patent No.: US 8,859,919 B2
(45) Date of Patent: Oct. 14, 2014

(54) METHODS AND APPARATUS FOR ASSEMBLING A CIRCUIT BREAKER

(75) Inventor: Xinhua Chen, Atlanta, GA (US)

(73) Assignee: Siemens Aktiengesellschaft, München (DE)

( * ) Notice: Subject to any disclaimer, the term of this patent is extended or adjusted under 35 U.S.C. 154(b) by 248 days.

(21) Appl. No.: 13/478,718

(22) Filed: May 23, 2012

(65) Prior Publication Data

US 2013/0313089 A1 Nov. 28, 2013

(51) Int. Cl.
*H01H 1/52* (2006.01)

(52) U.S. Cl.
USPC ..... 200/318

(58) Field of Classification Search
USPC ..... 200/318, 187, 189, 244, 318.1, 320, 200/325, 401; 335/23–25, 166–168, 335/170–175; 29/622
See application file for complete search history.

(56) References Cited

U.S. PATENT DOCUMENTS 5,444,423 A * 8/1995 Venzke et al. ..... 335/167
5,898,146 A * 4/1999 Beck et al. ..... 200/401
6,924,446 B1 * 8/2005 Marks et al. ..... 200/318

* cited by examiner

*Primary Examiner* — Edwin A. Leon

(57) ABSTRACT

Circuit breaker assembly methods and apparatus are provided. Embodiments include side frames of a latching mechanism of a circuit breaker trip unit. Each side frame includes a location tab. Embodiments also include a housing adapted to contain the circuit breaker trip unit, the side frames and a latching mechanism. The housing includes at least two cutouts for recieving the location tabs of the side frames. Insertion of the location tabs into the cutouts in the housing operationally aligns a latching mechanism coupled to the side frames with a circuit breaker trip unit. Numerous additional features are shown.

20 Claims, 9 Drawing Sheets

100

METHODS AND APPARATUS FOR ASSEMBLING A CIRCUIT BREAKER

FIELD

The present invention generally relates to circuit breakers, and more particularly is directed to methods and apparatus for assembling a circuit breaker.

BACKGROUND

Circuit breakers with thermomagnetic tripping means are well known in commercial and industrial applications. For example, U.S. Pat. No. 3,162,739 discloses a breaker which has a bimetallic strip element for thermal trip and an electromagnetic element for instantaneous trip. Thermomagnetic circuit breakers are commonly used in distribution panels to incorporate both techniques with the electromagnetic element responding instantaneously to large surges in current (e.g., short circuits) and the bimetallic strip element responding to less extreme, but longer-term over-current conditions. The thermal portion of the circuit breaker provides an "inverse time" response feature which provides faster or slower response for larger or smaller over currents respectively.

When a fault is detected (e.g., the breaker's current rating is exceeded), the electromagnet disposed around the load conductor attracts an armature linked to a latched tripbar which rotates to release stored energy within the trip unit which then trips a frame and opens the contacts to interrupt the circuit. Typically, in an electromagnet system, a spring is used to hold the armature until a sufficient in-rush of current occurs which creates a magnetic force in the electromagnet strong enough to compress the spring and pull, the armature towards the electromagnet which trips the breaker. The initial length and force needed to compress the spring is calibrated to provide an amount of force sufficent to prevent movement of the armature until there is a large enough in-rush of current. The position and orientation of the latching mechanism affect the calibration of the circuit breaker and in order to manufacture circuit breakers that can be calibrated to perform consistently, it is desirable that the latching mechanism be consistently located relative to the trip unit. Thus, what is needed are methods and apparatus that facilitate efficient and consistent assembly of circuit breakers with the latching mechanism properly positioned and aligned.

SUMMARY

Inventive methods and apparatus are provided for the efficient and accurate assembly of a circuit breaker. The invention provides a circuit breaker assembly apparatus that includes at least two side frames of a latching mechanism of a circuit breaker trip unit, each side frame including at least one location tab; and a housing adapted to contain the circuit breaker trip unit including the side frames and a latching mechanism, the housing including at least two cutouts adapted to receive the location tabs of the side frames. Insertion of the location tabs into the cutouts in the housing operationally aligns a latching mechanism coupled to the side frames with a circuit breaker trip unit.

In some other embodiments, a circuit breaker is provided that includes a trip unit; a latching mechanism adapted to be operatively coupled to the trip unit; and a housing adapted to contain the trip unit and the latching mechanism. The latching mechanism includes at least two side frames, each of the side frames includes at least one location tab, the housing includes at least two cutouts adapted to receive the location tabs of the side frames, and the location of the cutouts in the housing causes the latching mechanism to be operationally aligned with the trip unit upon the location tabs being inserted into the cutouts.

In yet other embodiments, a method of assembling a circuit breaker is provided. The method includes providing a latching mechanism of a circuit breaker trip unit, the latching mechanism including at least two side frames each having at least one location tab formed therein; providing a housing adapted to contain the circuit breaker trip unit, the housing having at least two cutouts formed therein and adapted to receive the location tabs of the side frames; and inserting the location tabs into the cutouts of the housing to cause the latching mechanism to be operationally aligned with the circuit breaker trip unit.

Numerous other aspects are provided. Other features and aspects of the present invention will become more fully apparent from the following detailed description, the appended claims and the accompanying drawings

DETAILED DESCRIPTION

The present invention provides improved methods and apparatus for easily, accurately, and efficiently assembling a circuit breaker. More specifically, the present invention provides a latching mechanism that includes attached side frames which have location tabs formed in the lower edge of each of the side frames. The location tabs are disposed to mate with cutouts in the housing of the circuit breaker and thereby cause the latching mechanism to be operatively aligned with the trip unit of the circuit breaker which also mounts to the housing. The location tabs are sized to fit securely in the cutouts to prevent relative lateral motion between the trip unit and the housing once the location tabs are fully inserted into the cutouts.

Figure 1:
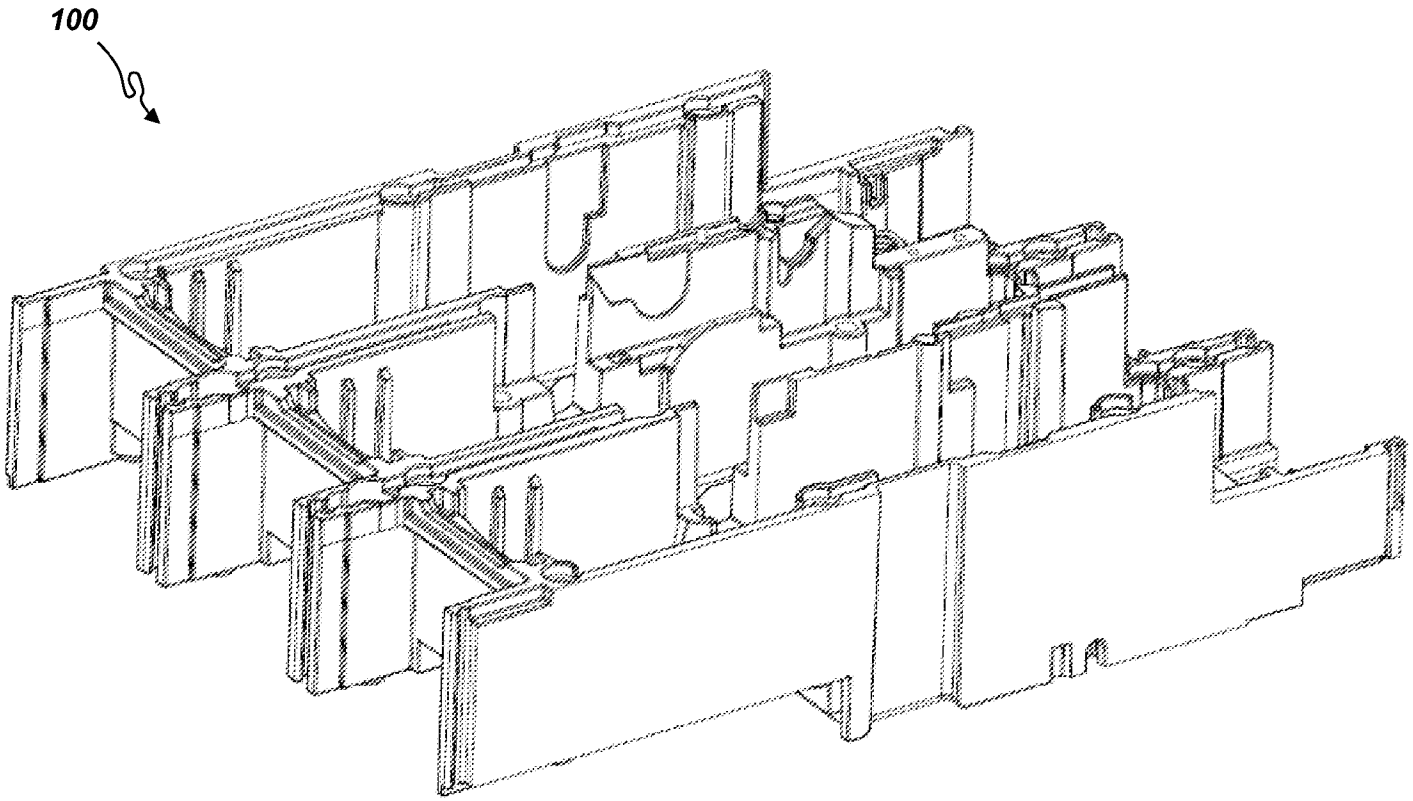
FIG. 1 is a diagram depicting a perspective view of an example lower housing for a circuit breaker according to embodiments of the present invention.

Turning to FIG. 1, a perspective view of an example lower housing 100 of a circuit breaker is provided. The lower housing 100 is adapted to serve as a frame or base for securely mounting components of the circuit breaker. For example, the lower housing 100 of the present invention is adapted to have a latching mechanism and a trip unit mounted.

Figure 2:
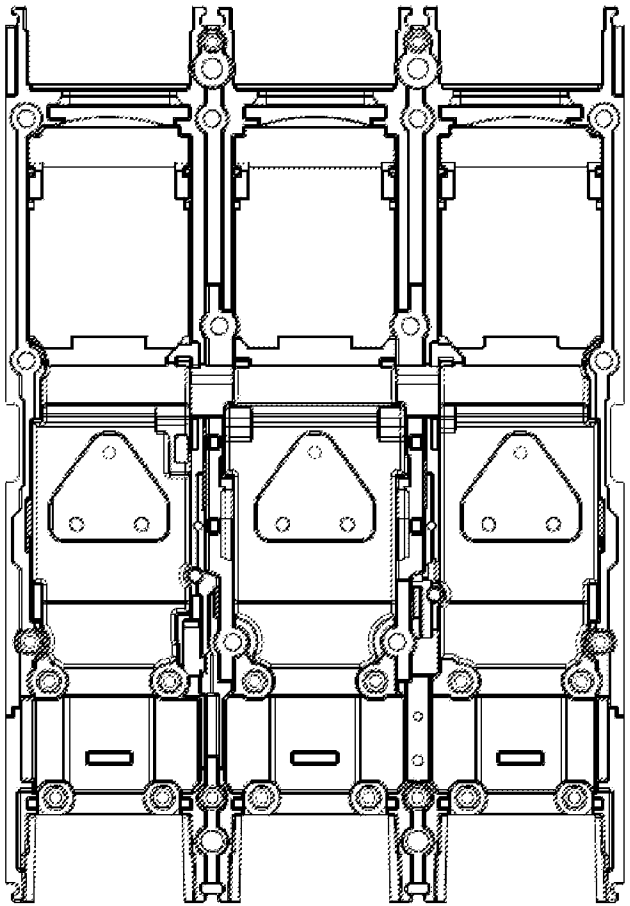
FIG. 2 is a diagram depicting a top view of an example lower housing for a circuit breaker according to embodiments of the present invention.

In some embodiments, the lower housing 100 is constructed of a rigid, insulating material such as, for example, thermoset bulk molding compound (MC). However, the lower housing 100 may be made of any practicable material. The lower housing 100 is also adapted to couple to an upper housing (not show) to enclose the circuit breaker. FIG. 2 provides a top view of the lower housing 100 of FIG. 1.

Note that the particular lower housing 100 shown in FIGS. 1 and 2 is merely an example of a suitable housing for use with embodiments of the present invention. Other alternative lower housings having different shapes, sizes, and structures may be used with the present invention.

Figure 3:
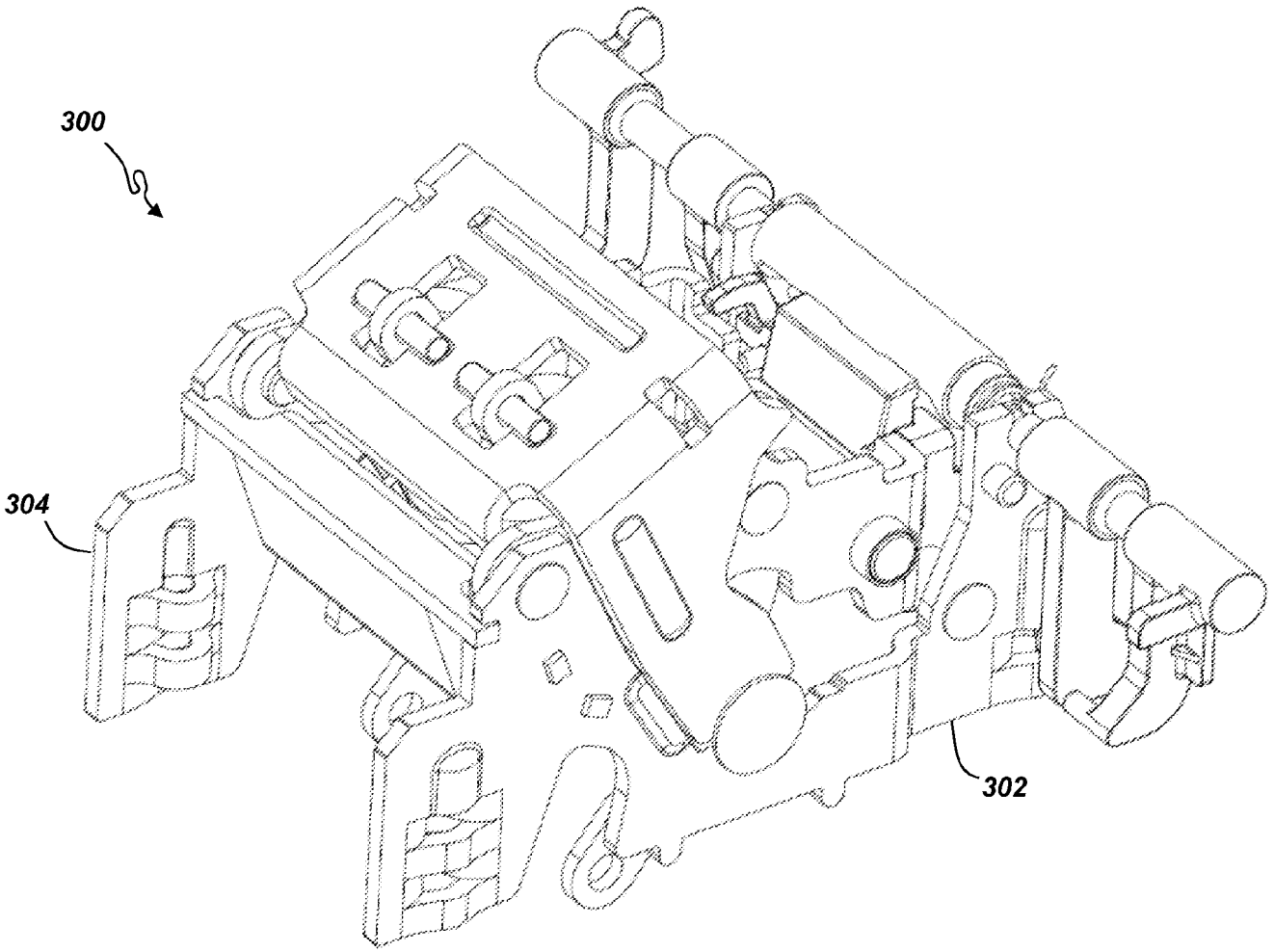
FIG. 3 is a diagram depicting a perspective view of an example latching mechanism for a circuit breaker according to embodiments of the present invention.
Figure 4:
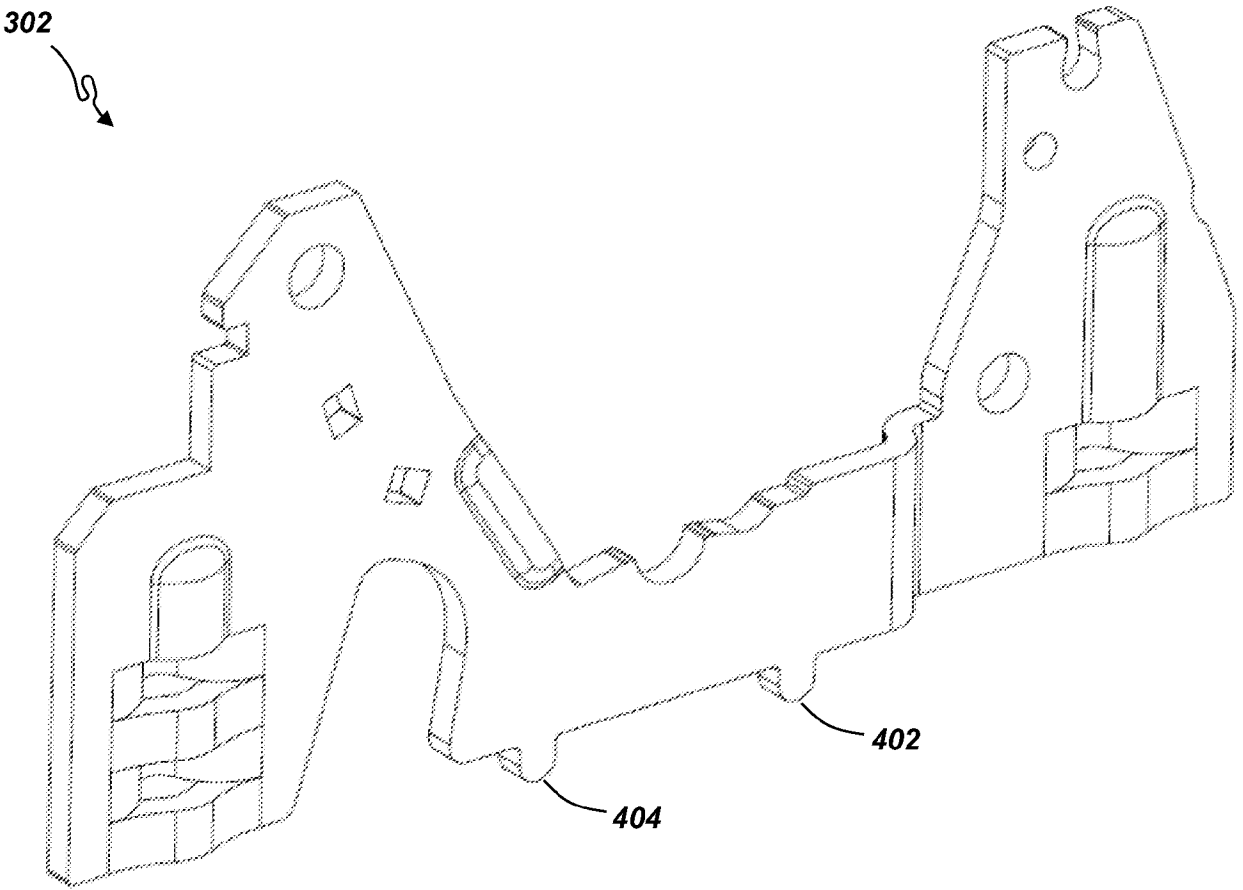
FIG. 4 is a diagram depicting a perspective view of an example right-side side frame of a latching mechanism for a circuit breaker according to embodiments of the present invention.

Turning to FIG. 3, an example latching mechanism 300 for a trip unit of a circuit breaker is shown. The latching mechanism 300 includes two side frames (right-side side frame 302 and left-side side frame 304) which are securely coupled to respective sides of the latching mechanism 300. FIGS. 4 and 3 provide a more detailed view of the right-side side frame 302 and left-side side frame 304, respectively. In some embodiments, the side frames 302, 304 may be constructed of a rigid material such as American Iron and Steel Institute (AISI) cold rolled steel. However, the side frames 302, 304 may be made of any practicable material in the embodiments pictured in FIGS. 4 and 5, the side frames 302, 304 are formed in stamped metal that is approximately 0.10 in. to approximately 0.135 in. thick. In some embodiments, other thicknesses may be used.

In the lower edge of the right-side side frame 302 are formed two location tabs 402,404. Likewise, in the lower edge of the left-side side frame 304, two location tabs 502,504 are formed. In some embodiments, more or fewer location tabs may be formed in each of the side frames 302, 304. The location tabs 402,404,502,504 may be spread apart from each other to provide more stable support for the latching mechanism 300 when it is installed in the housing 100. In some embodiments, the location tabs 402,404,502,504 on a given side frame 302,304 may be approximately 1.00 in. to approximately 1.50 in. apart from each other. In some embodiments, other different separations may be used.

Figure 5:
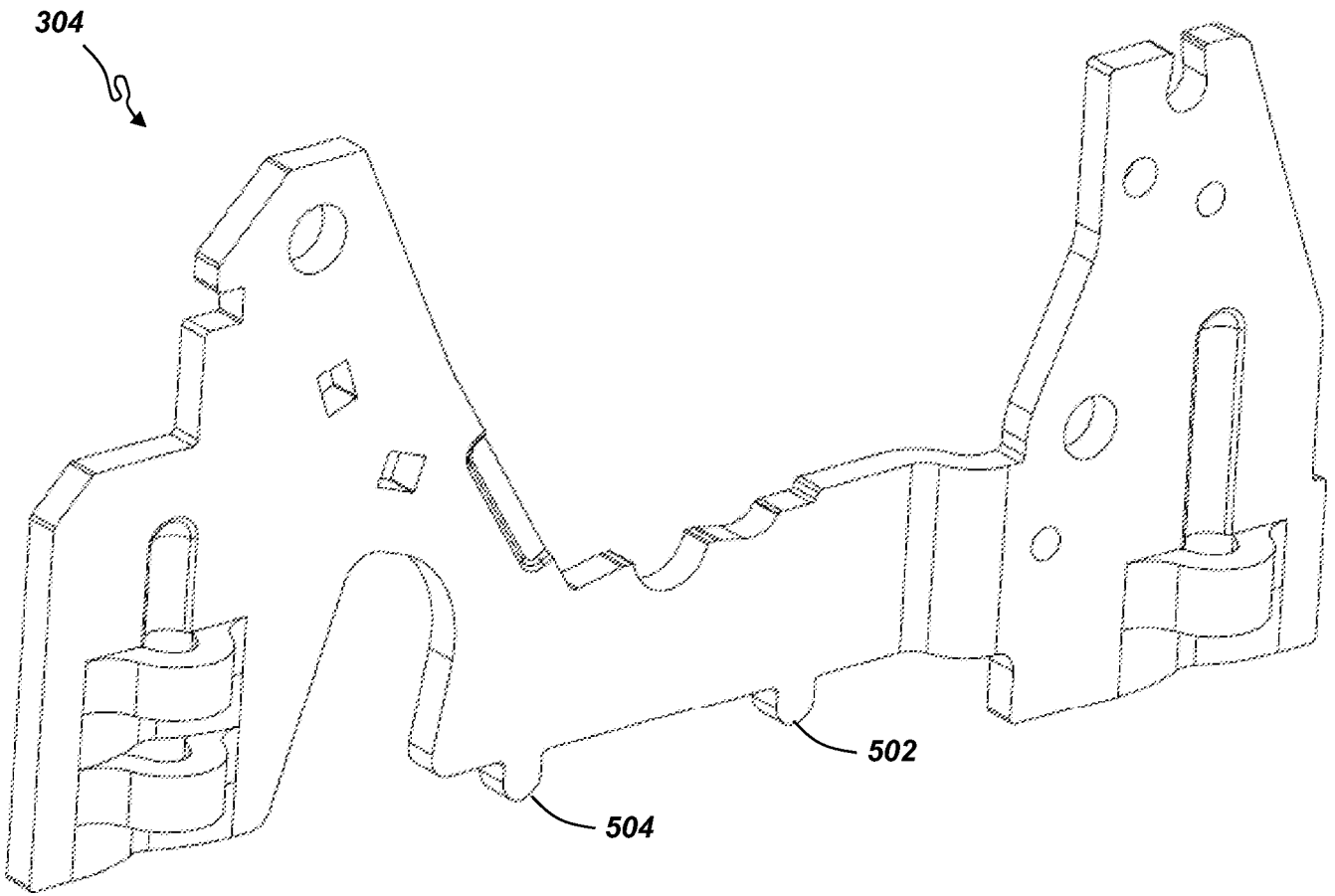
FIG. 5 is a diagram depicting a perspective view of an example left-side side frame of a latching mechanism for a circuit breaker according to embodiments of the present invention.

The example location tabs 402,404,502,504 depicted in FIGS. 4 and 5 are uniform in size and shape. However, in some embodiments, the location tabs 402,404,502,504 may have sizes and shapes that are different than each other. The location tabs 402,404,502,504 may be formed with a rectangular cross-section to match the size and shape of the cutouts in the housing 100. The location tabs 402,404,502,504 may have a thickness approximately equal to the thickness of the side frames 302,304. However, location tabs 402,404,502,504 with other thicknesses may used. The width of the location tabs 402,404,502,504 may be approximately 0.15 in. to approximately 0.25 in. In some embodiments, other widths may be used. The depth of the location tabs 402,404,502,504 may be approximately 0.15 in. to approximately 0.25 in. In some embodiments, other depths may be used.

Figure 6:
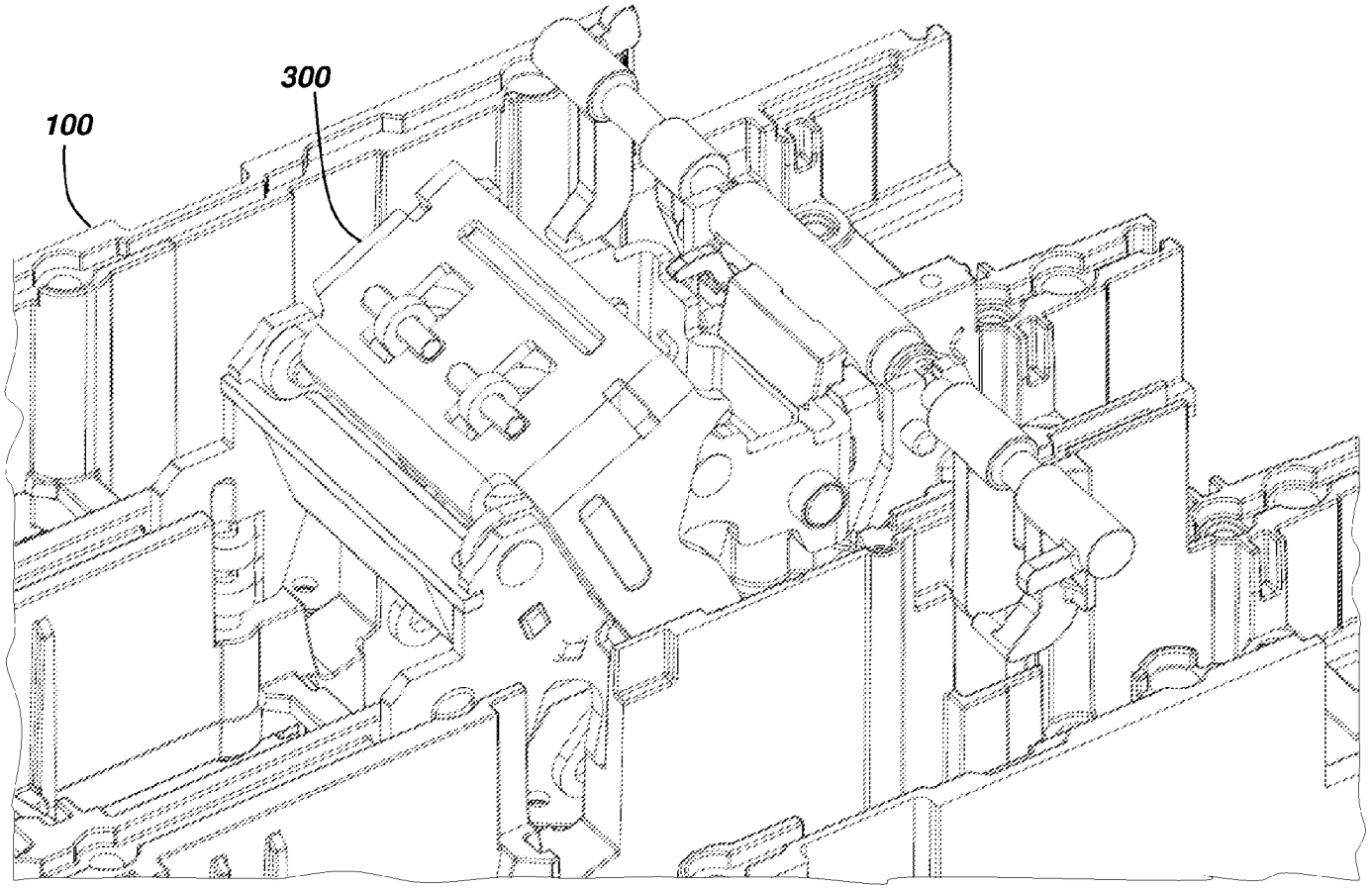
FIG. 6 is a diagram depicting a perspective view of an example latching mechanism installed in a lower housing of a circuit breaker according to embodiments of the present invention.
Figure 7:
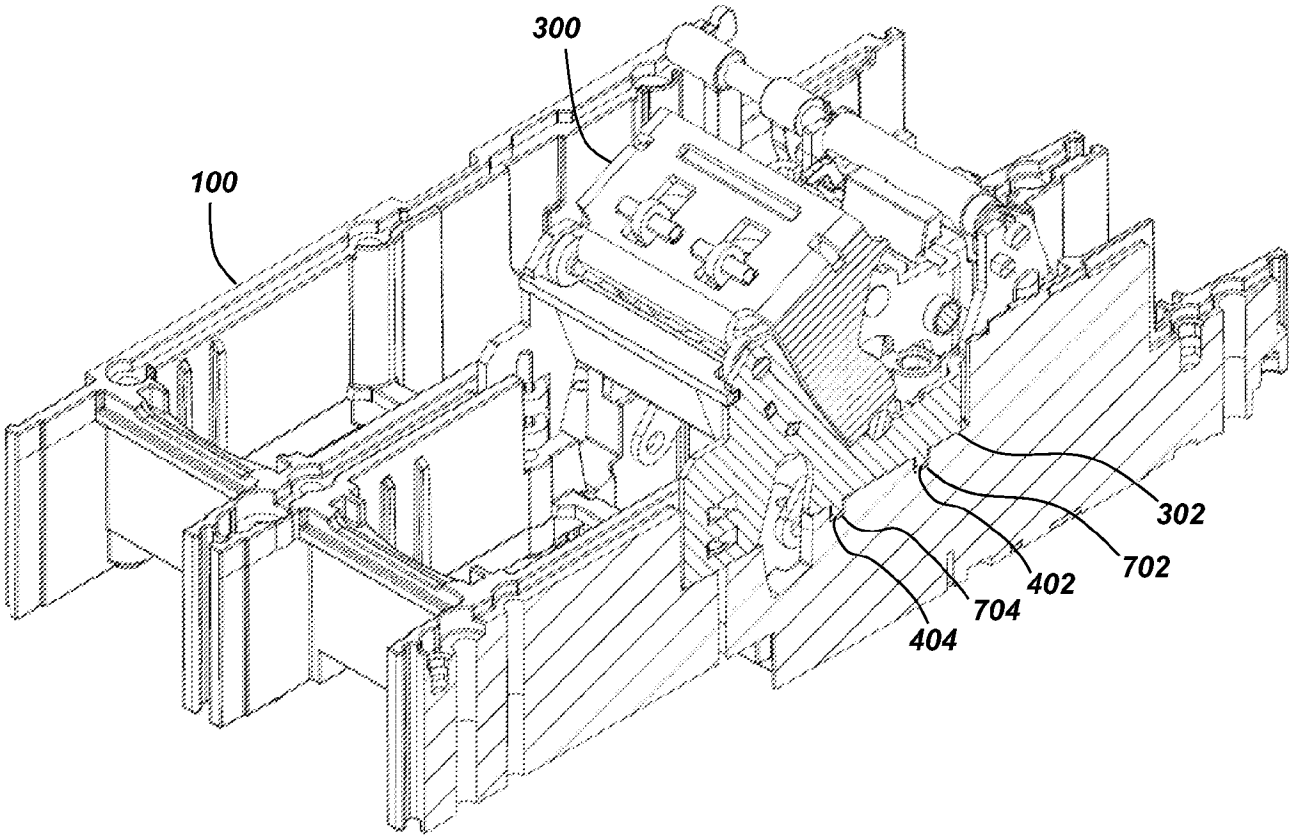
FIG. 7 is a diagram depicting a perspective cut--away view at the right-side side frame of an example latching mechanism installed in a lower housing of a circuit breaker according to embodiments of the present invention.
Figure 8:
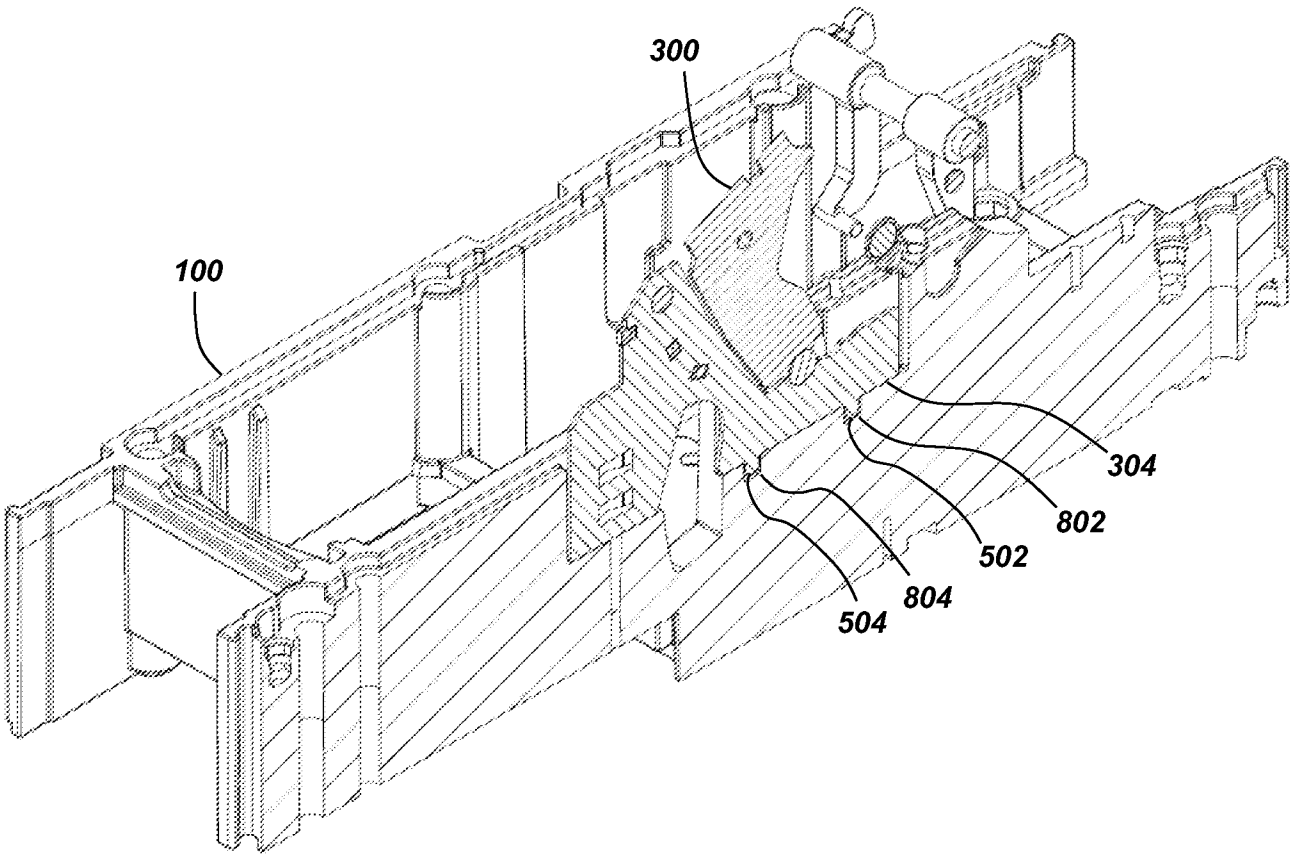
FIG. 8 is a diagram depicting a perspective cut-away view at the left-side side frame of an example latching mechanism installed in a lower housing of a circuit breaker according to embodiments of the present invention.

In some embodiments, the location tabs 402,404,502,504 may be rounded, as shown in FIGS. 4 and 5, to facilitate easier insertion of the location tabs 402,404,502,504 into the housing cutouts. However, squared location tabs or location tabs with other shapes may be used in some embodiments. In embodiments, location tabs with a wedged or pointed shape may be used Turning now to FIGS. 6 through 8, diagrams depicting the example latching mechanism 300 of FIG. 3 installed in the lower housing 100 of FIGS. 1 and 2, are provided. FIG. 6 provides a full perspective view while FIG. 7 and 8 provide cut-away cross-sectional perspective views. Specifically, FIG. 7 illustrates the latching mechanism 300 and the lower housing 100 cut along the right-side side frame 302 and FIG. 8 illustrates the latching mechanism 300 and the lower housing 100 cut along the left-side side frame 304. In FIG. 7, location tab 402 of the side frame 302 is shown fully inserted into cutout 702 of the housing 100. Likewise, location tab 404 of side frame 302 is shown fully inserted into cutout 704 of the housing 100. In FIG. 8, location tab 502 of the side frame 304 is shown fully inserted into cutout 802 of the housing 100. Likewise, location tab 504 of side frame 304 is shown fully inserted into cutout 804 of the housing 100.

The cutouts 702,704,802,804 may be sized and shaped to match the size and shape of the location tabs 402,404,502,504 in some embodiments, the cutouts 702,704,802,804 may be approximately 0.02 in. to approximately 0.04 in. larger than the cross-section of the location tabs 402,404,502,504 to allow the tabs to be inserted into the cutouts.

The cutouts 702,704,802,804 are disposed to locate the latching mechanism 300 at a desired position and orientation relative to the housing 100 and other components coupled to the housing 100. For example, when the location tabs 402, 404,502,504 are fully inserted into the cutouts 702,704,802, 804, respectively, the latching mechanism 300 is operatively aligned with a trip unit also coupled to the lower housing 100. Note that the side frames 302,304 and the lower housing 100 may additionally include openings to allow the latching mechanism 300 to be coupled to the housing 100 with various types of fasteners (e.g., nuts and bolts) once the latching mechanism 300 has been aligned with the housing 100 using the location tabs 402,404,502,504 and cutouts 702,704,802, 804.

Figure 9:
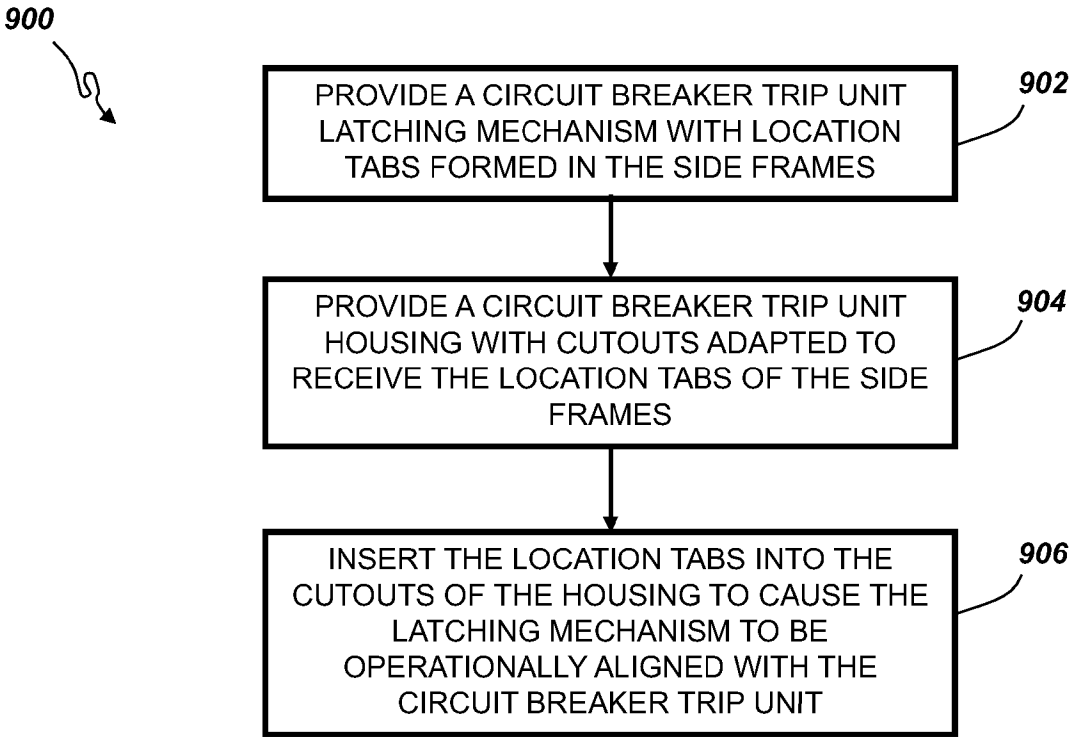
FIG. 9 is flowchart depicting an example method of assembling a circuit breaker according to embodiments of the present invention.

Turning to FIG. 9, flowchart, depicting an example method 900 of assembling a circuit breaker is provided. In Step 902, a latching mechanism 300 of a circuit breaker trip unit is provided. The latching mechanism 300 includes at least two side frames 302,304. The side frames 302,304 each have at least one location tab 402,502 formed, for example, in the lower edge of the side frames 302,304.

in Step 904, a housing 100 adapted to contain the circuit breaker including the latching mechanism 300 and a trip unit, is provided. The housing 100 includes at least two cutouts 702,802 formed therein and the cutouts 702,802 are adapted to receive the location tabs 402,502 of the side frames 302, 304. In Step 906, the location tabs 402,502 are inserted into the cutouts 702,802 of the housing 100 to cause the latching mechanism 300 to be operationally aligned with the trip unit of the circuit breaker.

In some embodiments, the two side frames each include at least two location tabs formed in each of the side frames. In such embodiments, the housing includes at least four cutouts adapted to receive the location tabs of the side frames. In some embodiments, the location tabs are formed with rounded corners that facilitate insertion of the location tabs into the cutouts of the housing. In some embodiments, the location tabs are separated from each other to increase the stability of the latching mechanism in the house. In some embodiments, the location tabs are formed on the lower edge of the side frames. in some embodiments, the location tabs are formed with a rectangular cross-sectional shape and the cutouts are formed in a rectangular shape. The cutouts are sized to receive the location tabs and to prevent the latching mechanism from being moved laterally relative to the housing when the location tabs are fully inserted into the cutouts.

Accordingly, while the present invention has been disclosed in connection with the preferred embodiments thereof, it should be understood that other embodiments may fall within the spirit and scope of the invention, as defined by the following claims.

The invention claimed is:

1. A circuit breaker assembly apparatus, the apparatus comprising:

at least two side frames of a latching mechanism of a circuit breaker trip unit, each side frame including at least one location tab; and a housing adapted to contain the circuit breaker trip unit including the side frames and a latching mechanism, the housing including at least two cutouts adapted to receive the location tabs of the side frames, wherein insertion of the location tabs into the cutouts in the housing operationally aligns a latching mechanism coupled to the side frames with a circuit breaker trip unit.

2. The apparatus of claim 1 wherein each of the side frames includes at least two location tabs, and the housing includes at least four cutouts adapted to receive the location tabs of the side frames.

3. The apparatus of claim 1 wherein each of the location tabs include rounded corners to facilitate insertion of the location tabs into the cutouts of the housing.

4. The apparatus of claim 1 wherein the side frames are adapted to support a latching mechanism in the housing.

5. The apparatus of claim 2 wherein the location tabs are disposed on the side frames separated from each other.

6. The apparatus of claim 5 wherein the location tabs are disposed on a lower edge of the side frames.

7. The apparatus of claim 1 wherein the location tabs have a rectangular cross-sectional shape and the cutouts in the housing are rectangular shaped and sized to receive the location tabs and prevent a latching mechanism coupled to the side frames from being moved laterally relative to the housing when the location tabs are fully inserted into the cutouts.

8. A circuit breaker comprising:

a trip unit;

a latching mechanism adapted to be operatively coupled to the trip unit; and a housing adapted to contain the trip unit and the latching mechanism, wherein the latching mechanism includes at least two side frames, each of the side frames includes at least one location tab, the housing includes at least two cutouts adapted to receive the location tabs of the side frames, and the location of the cutouts in the housing causes the latching mechanism to be operationally aligned with the trip unit upon the location tabs being inserted into the cutouts.

9. The circuit breaker of claim 8 wherein each of the side frames includes at least two location tabs and the housing includes at least four cutouts adapted to receive the location tabs of the side frames.

10. The circuit breaker of claim 8 wherein each of the location tabs include rounded corners to facilitate insertion of the location tabs into the cutouts of the housing.

11. The circuit breaker of claim 8 wherein the side frames support the latching mechanism in the housing.

12. The circuit breaker of claim 9 wherein the location tabs are disposed on the side frames separated from each other.

13. The circuit breaker of claim 9 wherein the location tabs are disposed on a lower edge of the side frames.

14. The circuit breaker of claim 8 wherein the location tabs have a rectangular cross-sectional shape and the cutouts in the housing are rectangular shaped and sized to receive the location tabs and prevent the latching mechanism from being moved laterally relative to the housing when the location tabs are fully inserted into the cutouts.

15. A method of assembling a circuit breaker, the method comprising:

providing a latching mechanism of a circuit breaker trip unit, the latching mechanism including at least two side frames each having at least one location tab formed therein;

providing a housing adapted to contain the circuit breaker trip unit, the housing having at least two cutouts formed therein and adapted to receive the location tabs of the side frames; and inserting the location tabs into the cutouts of the housing to cause the latching mechanism to be operationally aligned with the circuit breaker trip unit.

16. The method of claim 15 wherein providing a latching mechanism including at least two side frames includes providing a latching mechanism including at least two side frames with at least two location tabs formed in each of the side frames, and wherein providing a housing includes providing a housing having at least four cutouts adapted to receive the location tabs of the side frames.

17. The method of claim 15 wherein providing a latching mechanism including at least two side frames includes providing a latching mechanism including at least two side frames with location tabs formed with rounded corners that facilitate insertion of the location tabs into the cutouts of the housing.

18. The method of claim 15 wherein providing a latching mechanism including at least two side frames includes providing a latching mechanism including at least two side frames adapted to support the latching mechanism in the housing and having at least two location tabs formed on the side frames separated from each other.

19. The method of claim 15 wherein providing a latching mechanism including at least two side frames includes providing a latching mechanism including at least two side frames with at least one location tab formed on a lower edge of each of the side frames.

20. The method of claim 15 wherein providing a latching mechanism including at least two side frames includes providing a latching mechanism including at least two side frames with at least one location tab formed with a rectangular cross-sectional shape, and wherein providing a housing includes providing a housing with cutouts formed in a rectangular shape and size to receive the location tabs and to prevent the latching mechanism from being moved laterally relative to the housing when the location tabs are fully inserted into the cutouts.

* * * * *